US006340100B1

(12) United States Patent
Gill et al.

(10) Patent No.: US 6,340,100 B1
(45) Date of Patent: Jan. 22, 2002

(54) APPARATUS FOR SECURING A BULK BAG TO A DISCHARGE SPOUT

(75) Inventors: David R. Gill, Stewartsville, NJ (US); Dennis E. Graham, Bethlehem; John F. Simonof, Jr., Easton, both of PA (US)

(73) Assignee: Flexicon Corporation, Phillipsburg, NJ (US)

( * ) Notice: Subject to any disclaimer, the term of this patent is extended or adjusted under 35 U.S.C. 154(b) by 0 days.

(21) Appl. No.: 09/589,578

(22) Filed: Jun. 7, 2000

(51) Int. Cl.[7] ..... B65D 35/56

(52) U.S. Cl. ..... 222/105; 222/181.2; 222/185.1; 141/315

(58) Field of Search ..... 222/181.3, 181.2, 222/185.1, 105; 141/314, 315; 383/33

(56) References Cited

U.S. PATENT DOCUMENTS

| | | | | | |
|---|---|---|---|---|---|
| 4,735,543 | A | * | 4/1988 | St. Lawrence | 414/421 |
| 4,946,071 | A | | 8/1990 | Poulton | |
| 4,966,311 | A | * | 10/1990 | Taylor | 222/105 |
| 5,119,960 | A | * | 6/1992 | Robbins, III | 220/640 |
| 5,341,952 | A | * | 8/1994 | Goglio | 220/408 |
| 5,348,063 | A | * | 9/1994 | Handleman | 141/314 |
| 5,944,070 | A | * | 8/1999 | Schmidt et al. | 141/114 |
| 5,947,333 | A | * | 9/1999 | Hoffmann et al. | 222/105 |

FOREIGN PATENT DOCUMENTS

| | | |
|---|---|---|
| GB | 2205555 A | 6/1987 |
| GB | 2216504 A | 3/1988 |
| GB | 2225770 A | 12/1988 |
| GB | 2268164 A | 7/1992 |

* cited by examiner

*Primary Examiner*—Kevin Shaver
*Assistant Examiner*—Frederick C Nicolas
(74) *Attorney, Agent, or Firm*—Volpe and Koenig, P.C.

(57) ABSTRACT

A bulk bag unloading station wherein a bulk bag is suspended above a discharge receptacle. An assembly is provided for securing a spout extending from the bag to a discharge tube. The assembly comprises a clamp ring which defines a channel configured to receive the free edge of the tube therein. An actuator assembly is moveable between a first position where the clamp ring is spaced from the free edge and a second position where it overlies the tube free edge.

15 Claims, 10 Drawing Sheets

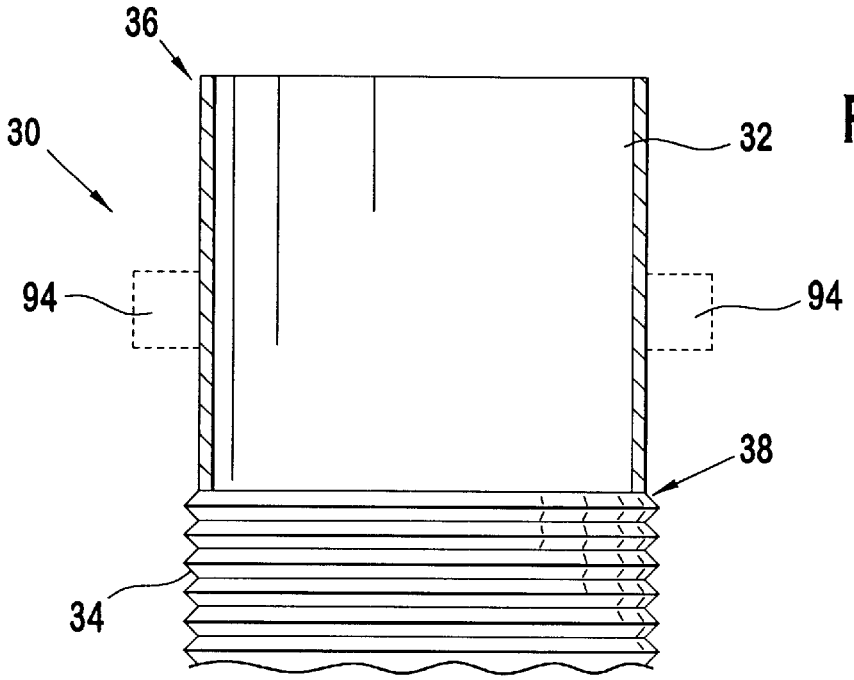
FIG. 4
FIG. 5
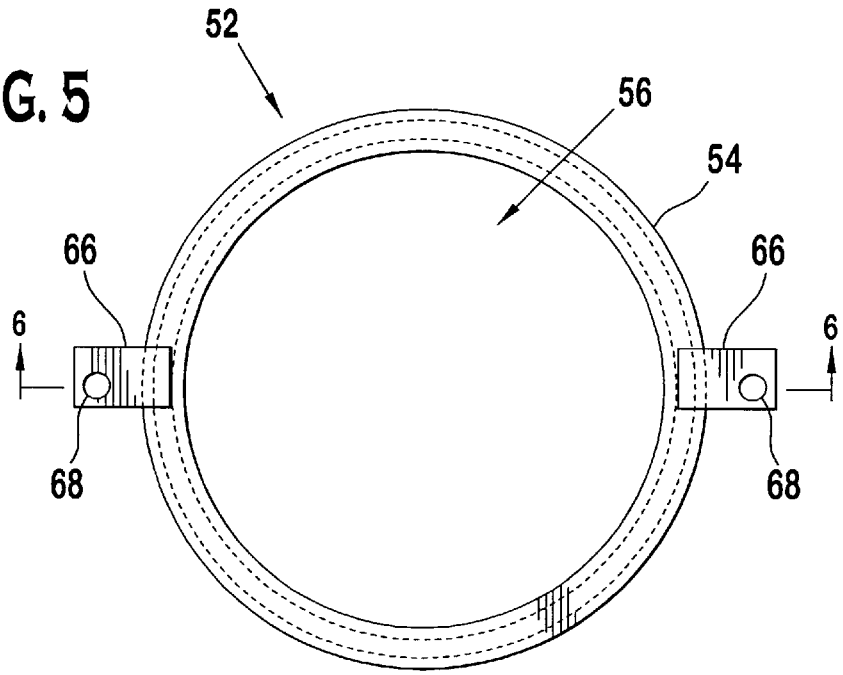
FIG. 6
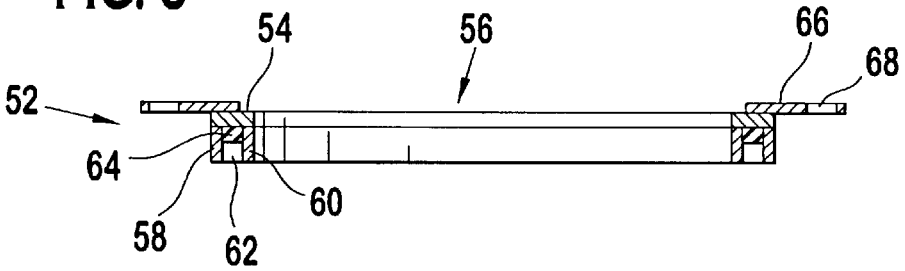

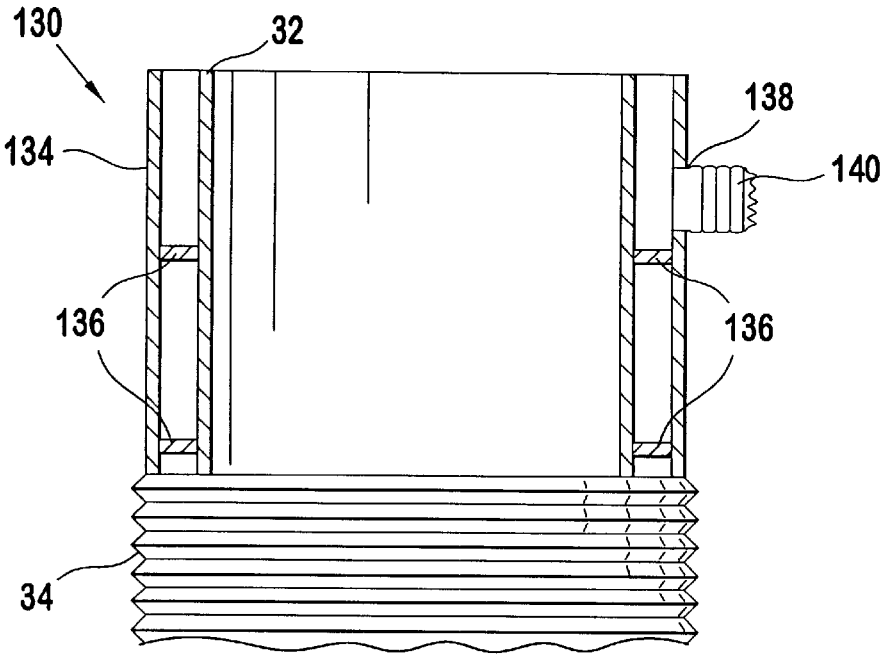
FIG. 13
FIG. 14
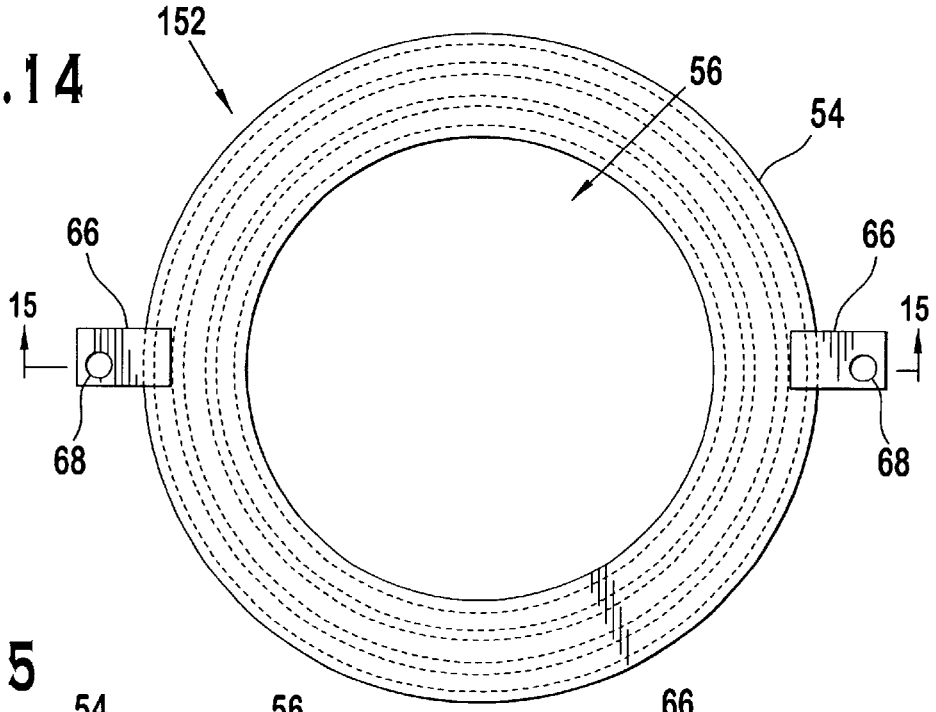
FIG. 15
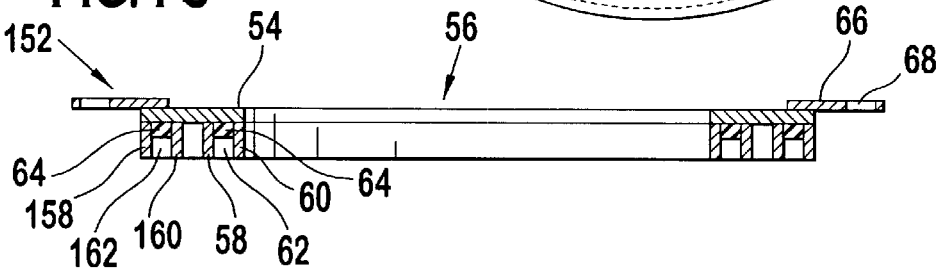

APPARATUS FOR SECURING A BULK BAG TO A DISCHARGE SPOUT

BACKGROUND

The present invention relates to the unloading of bulk bags used as containers for dry or moist particulate materials. The present invention more particularly relates to the unloading of bulk bag containers fabricated from cloth like material, such as woven polyester material, which is usually sewn in a cubical configuration.

Bulk bags made of heavy cloth material have been known in the art for sometime. It has also been known to provide the bag with heavy corner straps which support the bag when it is hung in a tower like support frame. The opposite end of the bag typically has an outlet spout which is aligned with the discharge unit of a receptacle, for example a conveyer, hopper or the like, through which the material is intended to be discharged.

To discharge the bag, the bag is hung in the support frame and material flows via gravity through the spout to the discharge unit. It is a characteristic of some particulate materials contained in a bag to resist or stop flowing out of the spout when the material remaining in the bag reaches the material's angle of repose or bridges over the spout. Since the bottom of the bag, where it is attached to the spout, is typically not at angle greater than the material's angle of repose, not all of the material will be discharged through the spout by gravity.

To address such, U.S. Pat. No. 5,184,759, commonly assigned with the present invention, discloses an apparatus which attaches to the spout and elongates the bag as material flows from the bag. As a result, the bottom of the bag forms more of a funnel shape, with the walls at an angle greater than the material's angle of repose, and the material flows more freely through the spout.

While the apparatus disclosed in U.S. Pat. No. 5,184,759 has proven successful at promoting freer flow from bulk bags, the manner in which the bag spout is attached to the moveable spout member has not always been the most desirable. With that devise, material may build up about the outside portion of the moveable spout. When the spout is released, the built-up material, particularly if it is a powdery material, may spill and contaminate the work environment.

U.S. Pat. No. 5,341,959 issued to Ellis discloses a means of connecting a bag spout to a moveable spout member with an internal securing configuration. However, this configuration is complex to manufacture and difficult to use. Due to the internal connection, an operator may have insufficient clearance to effectuate a proper connection inside the moveable spout member, particularly if the bag spout is short.

Accordingly, there is a need for a bulk bag unloading apparatus which includes a simpler, cleaner attachment arrangement.

SUMMARY

The present invention relates to a bulk bag unloading station wherein a bulk bag is suspended above a discharge receptacle. An assembly is provided for securing a spout extending from the bag to a discharge tube. The assembly comprises a clamp ring which defines a channel configured to receive the free edge of the tube therein and define a bag spout securing area. An actuator assembly is moveable between a first position where the clamp ring is spaced from the free edge and a second position where it overlies the tube free edge. In a preferred embodiment of the invention, the discharge tube is moveably mounted such that it extends the bag spout as the bag empties.

BRIEF DESCRIPTION OF THE DRAWINGS

FIG. 4 is a partial cross-sectional view of a preferred moveable spout member of the present invention.

FIG. 5 is a top plan view of a clamp ring useable with the preferred spout member of the present invention.

FIG. 6 is a cross-sectional view along the line 6—6 in FIG. 5.

FIG. 13 is a partial cross-sectional view of an alternate embodiment of the preferred moveable spout member of the present invention.

FIG. 14 is a top plan view of a clamp ring useable with the alternate embodiment of the present invention.

FIG. 15 is a cross-sectional view along the line 15—15 in FIG. 14.

DETAILED DESCRIPTION OF THE PREFERRED EMBODIMENTS

Figure 1:
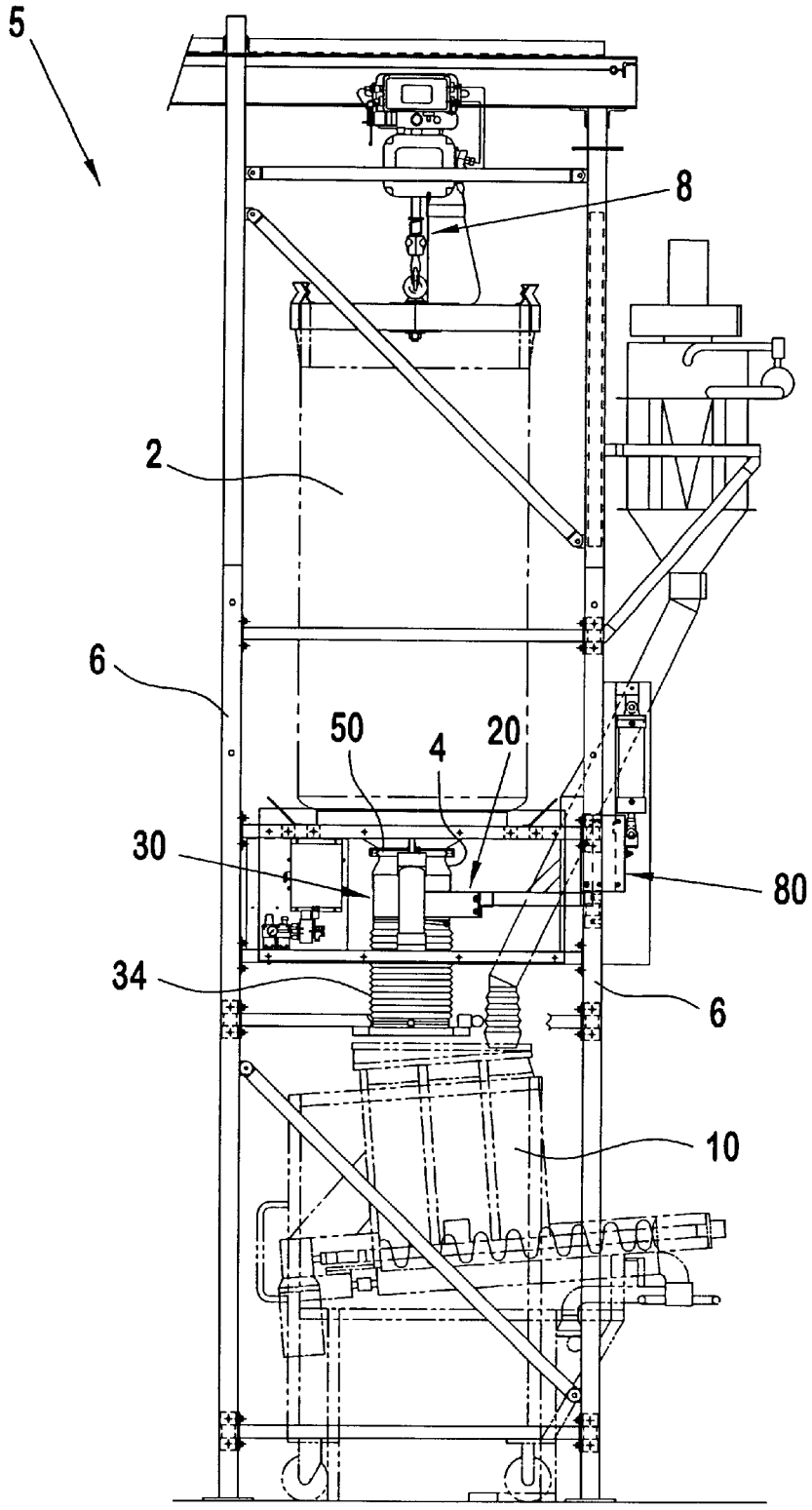
FIG. 1 is an elevation view of a bulk bag unloading station incorporating the present invention.

The preferred embodiments of the present invention will be described with reference to the drawing figures where like numerals represent like elements throughout.

An exemplary bulk bag unloading station 5 incorporating the present invention is shown in FIG. 1. The bulk bag unloading station 5 generally includes a support frame 6 from which a bulk bag 2 is suspended by the suspension assembly 8. A hoist mechanism is illustrated, but other suspension assemblies may be used. The suspension assembly forms no part of the invention. A discharge receptacle 10, for example a hopper, is positioned within the support frame beneath and in general alignment with the bulk bag 2. A spout adapter 20 is positioned between the bulk bag spout 4 and the discharge receptacle 10.

Figure 2:
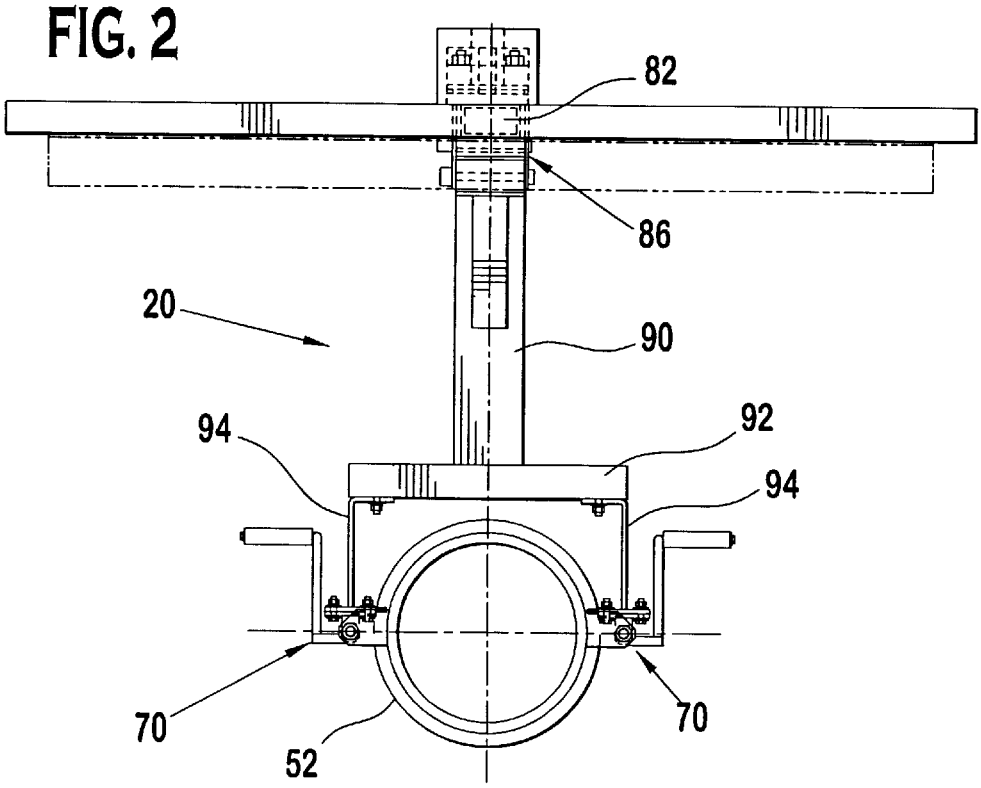
FIG. 2 is a top plan view of the preferred embodiment of the spout securing apparatus of the present invention.
Figure 3:
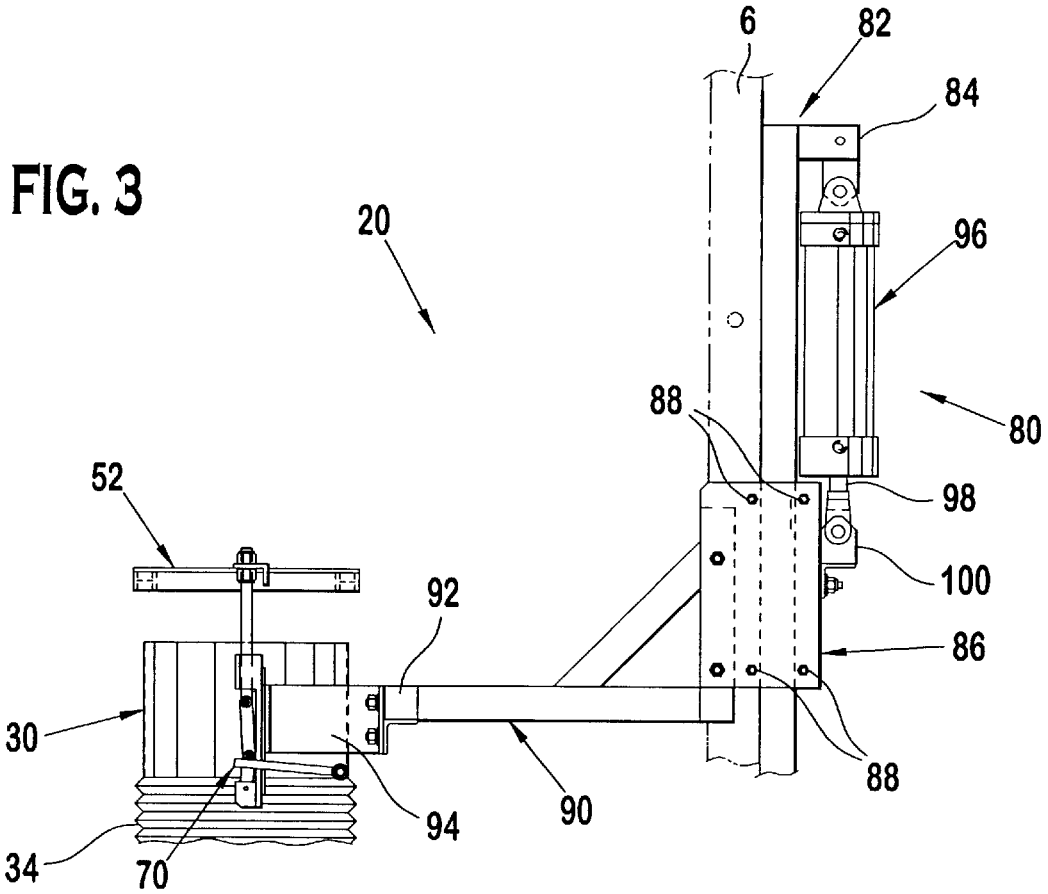
FIG. 3 is a side elevation view of the spout securing apparatus of FIG. 2.
Figure 7:
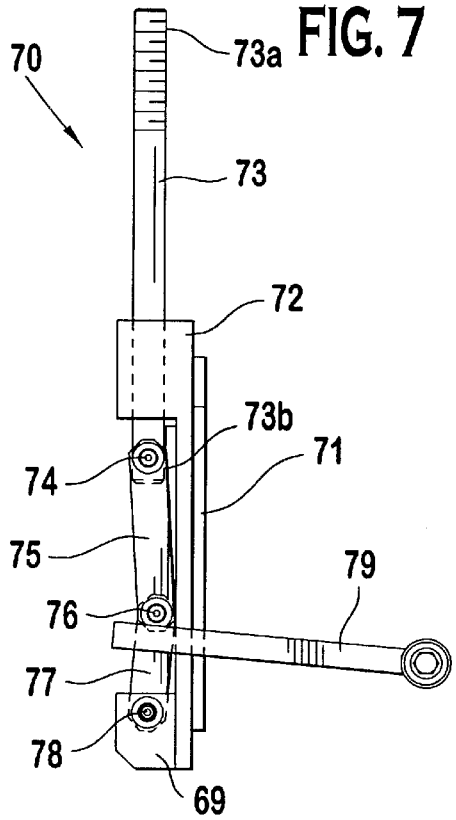
FIG. 7 is a side view and FIG. 8 is a front elevation of a preferred clamp actuator, useable with the present invention, in an extended position.
Figure 9:
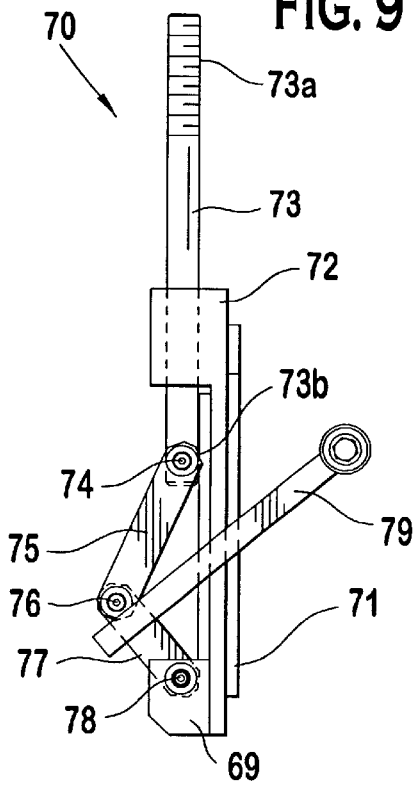
FIG. 9 is a side view and FIG. 10 is a front elevation of the preferred clamp actuator in transition.
Figure 8:
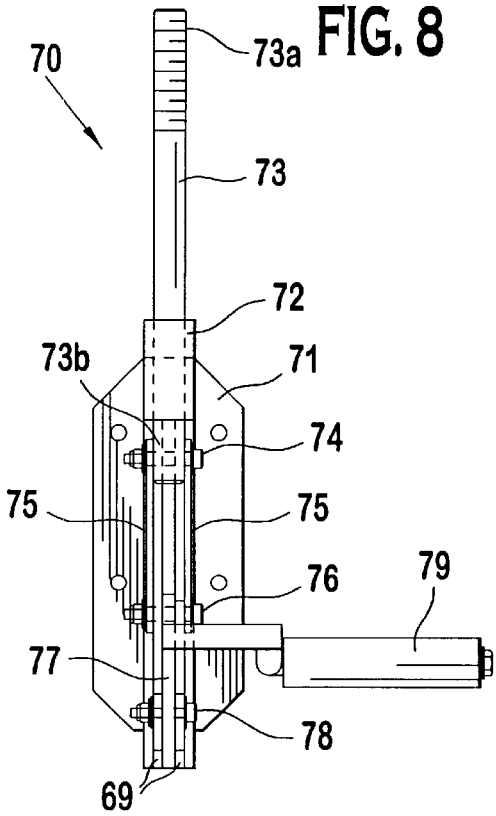

The preferred embodiments of the spout adapter 20 will be described in more detail with reference to FIGS. 2–15. Referring to FIGS. 2 and 3, the spout adapter 20 generally comprises a moveable discharge tube spout member 30, a clamp ring assembly 50 and a control assembly 80. The preferred control assembly 80 includes vertical mounting bracket 82 secured on the support frame 6. Trolley assembly 86 is mounted to and moveable along the vertical mounting bracket 82 by the plurality of roller assemblies 88. Opposed mounts 84 and 100 extend from the vertical mounting bracket 82 and the trolley assembly 86, respectively. A fluid actuator 96, including an extendable rod 98, is mounted between the opposed mounts 84 and 100.

The support frame 90 extends from the trolley assembly 86 toward the moveable spout member 30. In the preferred embodiment, the support frame 90 includes a cross-bar 92 which supports a pair of opposed brackets 94 that connect to the moveable spout member 30. The cross-bar 92 and opposed brackets 94 are preferred as they provide a balanced attachment for the spout member 30 about the center-line thereof, however, other attachment means may be utilized.

Referring to FIG. 3, movement of the moveable spout member 30 corresponds to movement of the actuator rod 98 as translated through the trolley assembly 86. Downward movement of the moveable spout member 30 may occur either by positive actuation of the fluid actuator 96 to drive the rod 98 downward or by gravity.

Referring to FIG. 4, a first embodiment of the moveable spout member 30 is illustrated. The moveable spout member 30 preferably comprises a cylindrical tube 32 having an inlet end 36 and an outlet end 38 and connected by the brackets 94, shown in phantom, to the control assembly 80 (not shown). The tube 32 is preferably manufactured from sheet metal, plastic or the like and is preferably cylindrical to complement the most common bag spout 4. Transition tube 34 extends from the outlet end 38 of the cylindrical tube 32 and communicates with the discharge receptacle 10. In the preferred embodiment, the transition tube 34, manufactured from a flexible, accordion folded material, is secured at opposed ends thereof to the cylindrical tube 32 and the discharge receptacle 10. The preferred material allows the transition tube 34 to expand and contract uniformly in response to movement of the cylindrical tube 32. Alternatively, the end of the transition tube 34 addressing the receptacle may be unattached, similar to the means described in U.S. Pat. No. 5,184,759.

Referring to FIGS. 5 and 6, the preferred clamp ring 52 is illustrated. Clamp ring 52 includes a ring or plate 54 which defines an aperture 56 having a diameter less than or equal to the inside diameter of the tube 32. A pair of spaced walls 58, 60 depend from the plate 54 to define a channel 62 configured to receive an upper edge of the spout tube 32. See FIG. 18. A gasket 64, manufactured from rubber or some other pliable material, is preferably positioned within the channel 62 adjacent to the plate 54. A pair of opposed support brackets 66 extend from the plate 54.

Referring to FIGS. 2 and 3, the moveable spout member 30 and the clamp ring 52 are preferably interconnected by a pair of clamp actuators 70. The preferred clamp actuators 70 will be described with reference to FIGS. 7–12. Each preferred clamp actuator 70 includes a mounting bracket 71 which is securable either directly to the spout tube 32 or to the brackets 94. An apertured guide block 72 is attached proximate the top of the mounting bracket 71 and a pair of pivot mounts 69 extend from a lower portion of the mounting bracket 71. A rod 73 extends through the aperture in the guide block 72 for slidable movement therethrough. A first end 73a of the rod 73 is configured for connection with a respective support bracket 66 on the clamp ring 52. In the preferred embodiment, the rod end 73*a* is threaded and extends through an aperture 68 in the support bracket 66 and is secured thereto with bolts (not shown) or the like. Other connection arrangements may also be utilized. The other end 73*b* of the rod 73 is configured for pivotal connection to a first pair of links 75 via pivot pin 74 or the like. The first pair of pivot links 75 are in turn pivotally connected to link 77 via pivot pin 76 or the like. Link 77 is pivotally connected to the mounting bracket mounts 69 via pivot point 78. A handle 79 is preferably secured to link.

Figure 10:
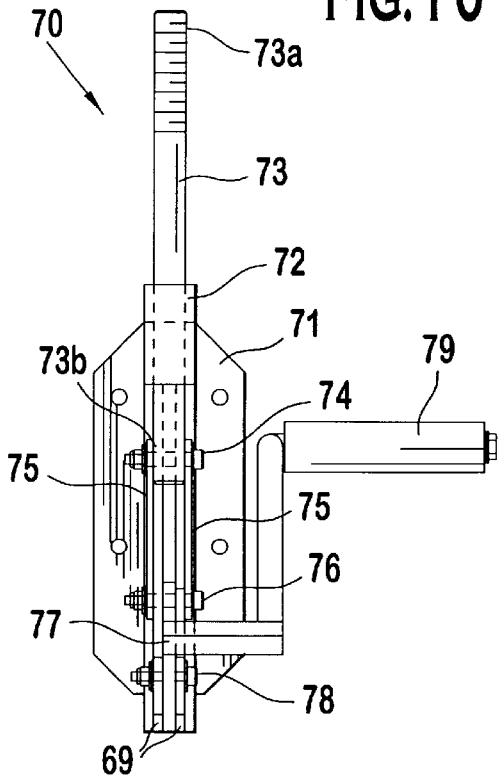
Figure 11:
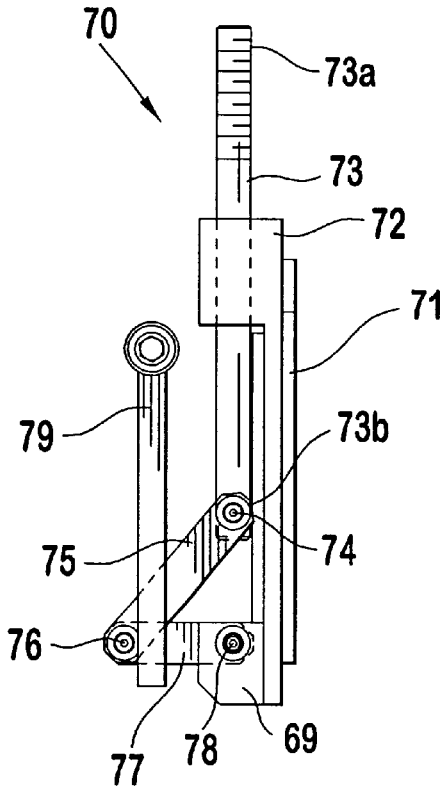
FIG. 11 is a side view and FIG. 12 is a front elevation of the preferred clamp actuator in a closed position.
Figure 12:
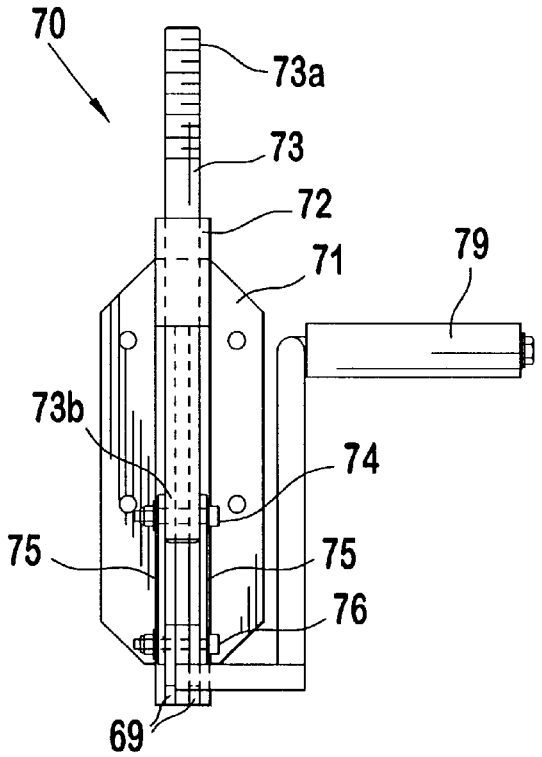

In an initial position, as shown in FIGS. 10 and 11, the links 75 and 77 are in substantial vertical alignment with the rod 73 is in an extended position. This position maintains the clamp ring 52 spaced from the moveable spout member 30 such that the bag spout 4 can be passed through the aperture 56 and positioned about the spout tube 32. It is preferable that the links 75 and 77 are not in complete alignment, but instead slightly offset toward the mounting bracket 71 (See FIG. 10). With such an alignment, the likelihood that the links 75, 77 will inadvertently rotate and lower the clamp ring 52 is reduced. Referring to FIGS. 12 and 13, to lower the clamp ring 52, the handle 79 is moved along an arcuate path whereby link 77 rotates about pivot pin 78 and correspondingly, through pivot point 76, links 75 rotate downward thereby, through pivot point 74, retracting the rod 73. Referring to FIGS. 14 and 15, the handle 79 is moved until link 77 is substantially horizontal and the links 75 are at an approximately forty-five degree (45°) angle thereto. The further downward travel of links 75 further retracts the rod 73. The links 75 and 77 are configured such that the stroke of the rod 73 causes engagement of the clamp ring 52 with the spout tube 32 and the linkage is effectively locked with the clamp ring 52 in a closed position. To release the clamp ring 52, the handle 79 is rotated back along its arcuate path. Other actuation means, for example a fluid actuator, may also be used.

Referring to FIG. 13, an alternative embodiment of the moveable spout member 130 is shown. Moveable spout member 130 includes an external tube 134 mounted about tube 32 by brackets 136 or the like. The control assembly 80 (not shown) is secured to the external tube 134 in a manner similar to the previous embodiment. Transition tube 34 extends from, and about, both tubes 32 and 134. External tube 134 includes an aperture 138 through which a vacuum apparatus 140 may be connected. The vacuum apparatus 140 extrudes fine particulate material which may attempt to escape the spout member 130.

Referring to FIGS. 14 and 15, clamp ring 152 is similar to clamp ring 52 and includes a plate 54 with an aperture 56 therethrough. Two pairs of spaced walls 58, 60 and 158, 160 depend from the plate 54 to define two channels 62 and 162. One channel 62 is configured to receive an upper edge of the spout tube 32 and the other channel 162 is configured to receive an upper edge of the external tube 134. A gasket 64 is preferably positioned in each of the channels 62 and 162. Again, a pair of opposed support brackets 66 extend from the plate 54 for interconnection to the actuators 70.

Having described the preferred components of the system, its operation will be further described with reference to FIGS. 16, 17, 18A, 18B, 19, 20, 21A and 21B.

Figure 16:
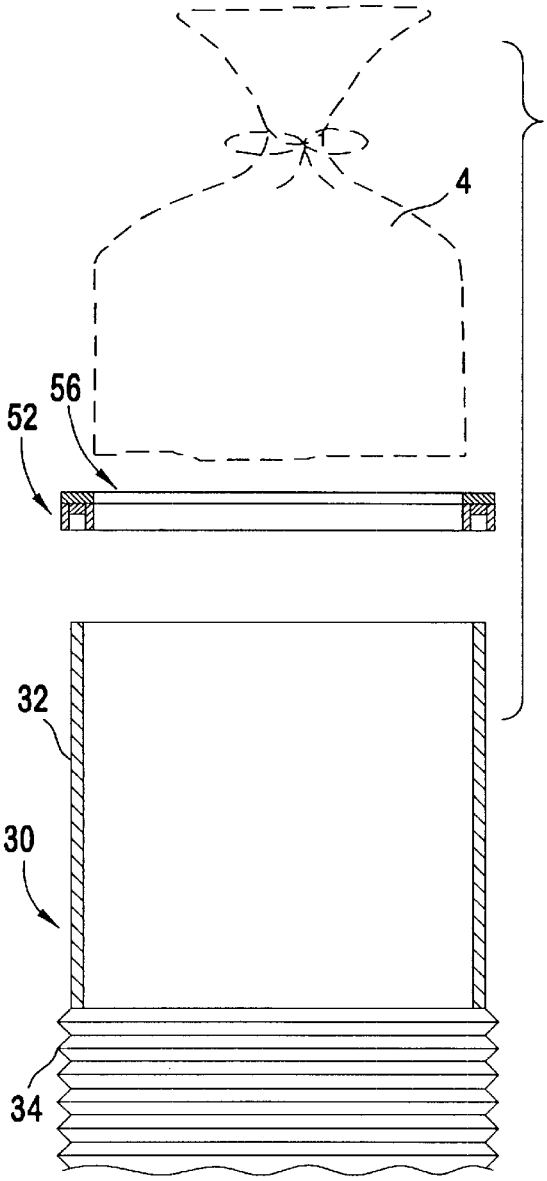
FIGS. 16, 17 and 18A progressively illustrate the clamping of a bag spout to the moveable spout member of FIG. 4.
Figure 17:
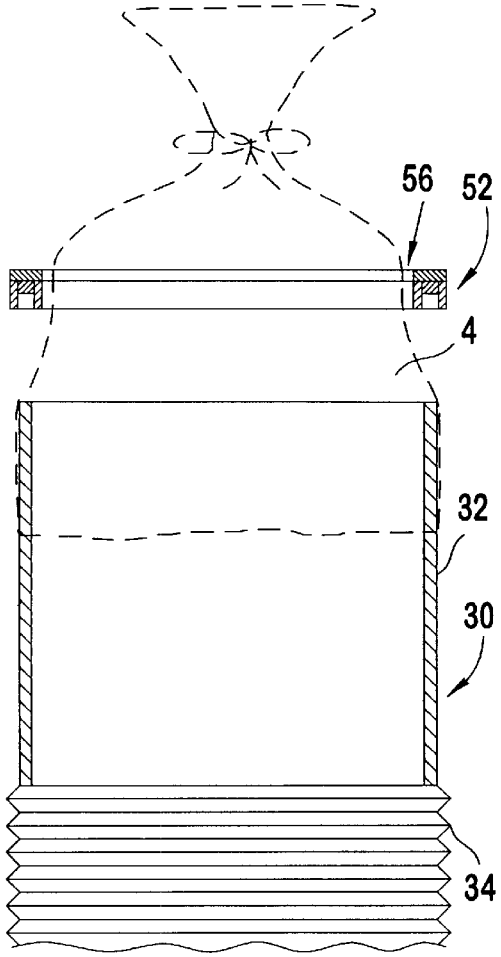
Figure 18A:
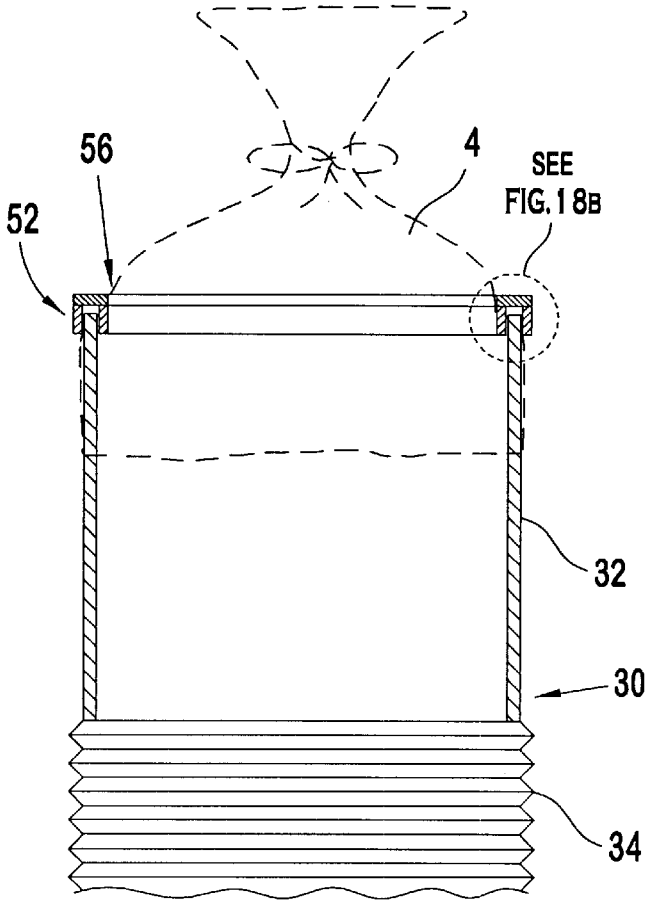
Figure 18B:
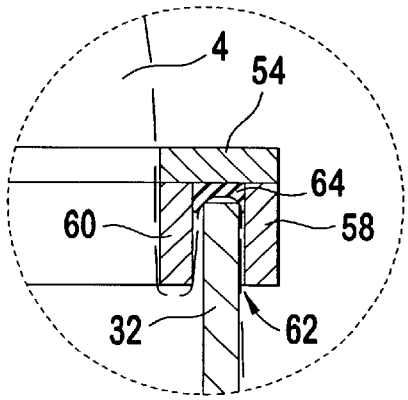
FIG. 18B is an enlarged view of the indicated portion of FIG. 18A showing the clamped position of the bag spout.
Figure 19:
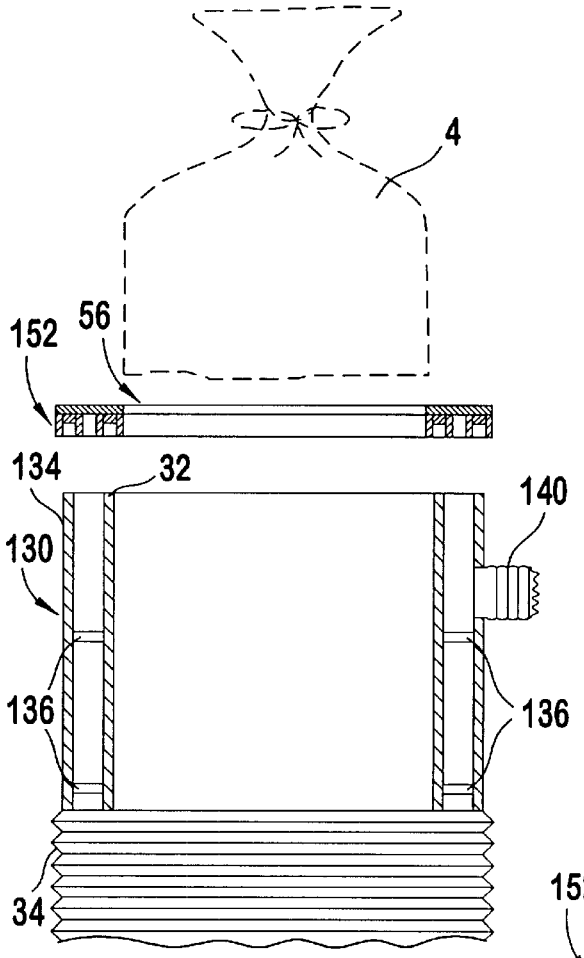
FIGS. 19, 20 and 21A progressively illustrate the clamping of a bag spout to the moveable spout member of FIG. 7.

Referring to FIG. 16, the spout adapter 20 is set in an initial position with the ring clamp 52 aligned above the moveable spout member 30. A bulk bag is positioned with its spout 4 aligned with the aperture 56 in the clamp ring 52. Referring to FIG. 17, the bag spout 4 is passed through the aperture 56 and positioned about the spout tube 32 without any extraneous preparation of the bag spout 4. Referring to FIG. 18A, the clamp ring 52 is lowered via the clamp actuators (not shown) until the upper edge of the tube 32 seats within the clamp ring channel 62. The bag spout 4 is thereby secured between the tube 32 and the clamp ring channel 62, as shown in detail in FIG. 18B. The gasket 64 provides resiliency to prevent excessive pinching of the bag spout 4 and to provide a more thorough seal. As can be seen in FIGS. 18A and 18B, the bag spout 4 is effectively sealed to the moveable spout member 30 with an unobstructed material path defined.

Figure 20:
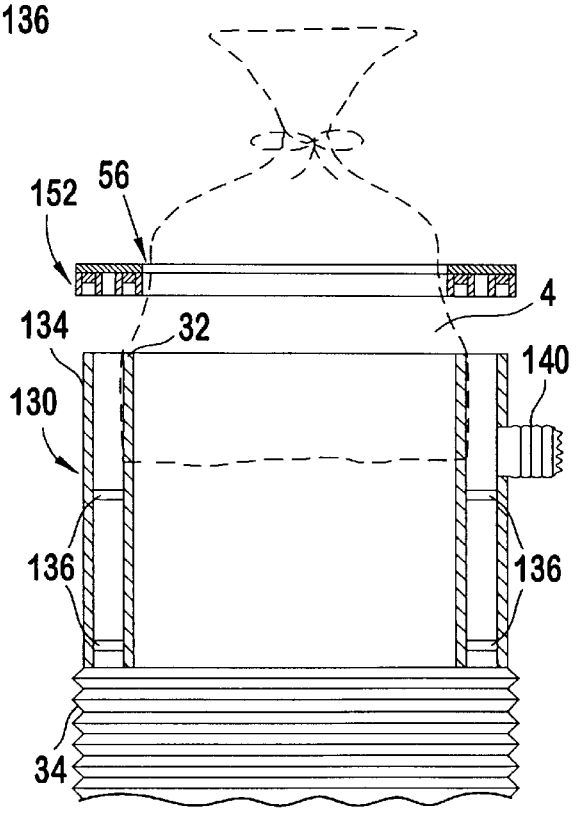
Figure 21A:
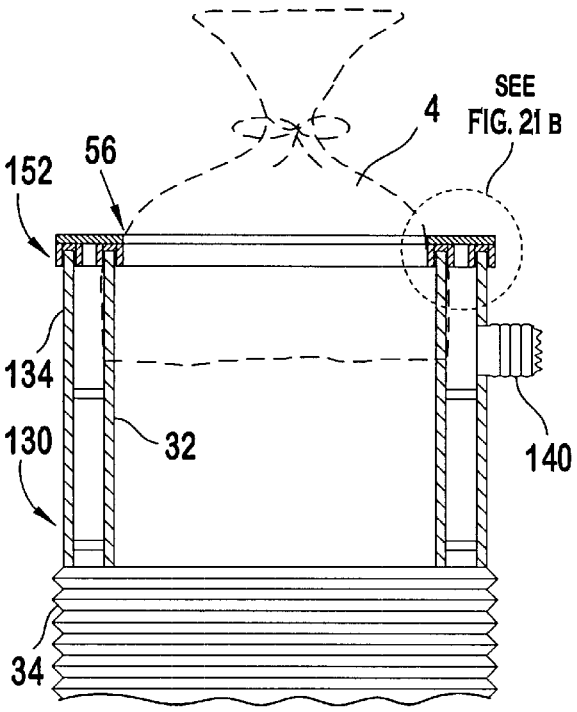
Figure 21B:
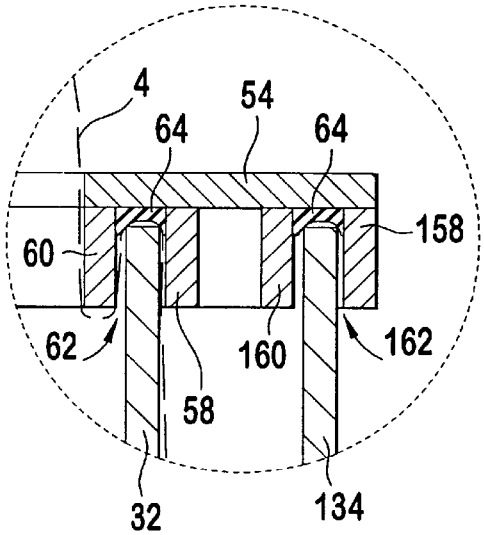
FIG. 21B is an enlarged view of the indicated portion of FIG. 21A showing the clamped position of the bag spout.

Referring to FIGS. 19, 20, 21A and 21B operation of the double wall embodiment is illustrated. As shown in FIG. 20, the bag spout 4 is again passed through the clamp ring aperture 56 and positioned about the spout tube 32. The brackets 136 are preferably positioned such that they do not interfere with the bag spout 4. Referring to FIG. 21A, the clamp ring 52 is lowered via the clamp actuators (not shown) until the upper edge of the tube 32 seats within clamp ring channel 62 and the upper edge of the external tube 134 seats within clamp ring channel 162. The bag spout 4 is thereby secured between the tube 32 and the clamp ring channel 62 and the external tube 134 seals against the clamp ring 152, as shown in detail in FIG. 21B. With the external tube 134 sealed by the clamp ring 152, any particulate remaining in the moveable spout member 130 can be extruded through the vacuum apparatus 140.

What is claimed is:

1. An assembly for securing a bulk bag spout to a discharge tube having internal and external surfaces and a free edge, and a bulk bag connected thereto, the combination comprising:

a clamp ring defining a channel configured to receive the free edge therein such that a portion of the channel overlies a portion of the internal surface and a portion of the external surface and defines a bag spout securing area; and an actuator assembly movable between a first position where the clamp ring is spaced from the free edge and a second position where it overlies the free edge so that a spout of the bulk bag located in the channel contacts the internal surface and the external surface of the discharge tube.

2. The assembly of claim 1 wherein a gasket is positioned in the channel.

3. The assembly of claim 1 wherein the clamp ring has a circular configuration with a circular aperture therethrough.

4. The assembly of claim 1 wherein the actuator assembly includes at least one fluid actuator.

5. The assembly of claim 1 wherein the actuator assembly comprises:

a mounting plate;

a guide member, secured to the mounting plate, through which a rod having first and second ends extends with its first end connected to the clamp ring;

a mount, secured to the mounting plate at a position spaced from the guide member;

first and second linkages, each having first and second ends, the first linkage pivotally connected adjacent one end to the mount and adjacent the other end to one end of the second linkage, the other end of the second linkage pivotally connected to the rod second end such that the rod moves between an extended position when the linkages are in a first position and a retracted position when the linkages are moved to a second position.

6. The assembly of claim 3 wherein the aperture has a diameter equal to or less than an internal diameter of a discharge tube which the clamp ring is adapted to receive.

7. The assembly of claim 5 wherein the actuator assembly further comprises a handle secured to the first linkage for controlling movement thereof.

8. The assembly of claim 5 wherein the rod extends in a first plane and an axis extending through the interconnection of the first and second linkages is in a second plane parallel to the first plane when the linkages are in the first position and the second plane is between the first plane and the mounting plate.

9. The assembly of claim 5 wherein the rod extends in a first plane and the first linkage extends in a second plane substantially perpendicular thereto when the linkages are in the second position.

10. A bulk bag unloading station comprising:

a frame structure;

a bag support assembly and a bulk bag supported thereon;

a discharge receptacle positioned below the bag support assembly;

a discharge tube secured to the frame structure at a position between the bag support assembly and the discharge receptacle, the tube having internal and external surfaces, a first end defining a free edge and a second end in communication with the discharge receptacle;

a clamp ring defining a channel configured to receive the free edge therein such that a portion of the channel overlies a portion of the internal surface and a portion of the external surface and defines a bag spout securing area;

an actuator assembly moveable between a first position where the clamp ring is spaced from the free edge and a second position where it overlies the free edge so that a spout of the bulk bag located in the channel contacts the internal surface and the external surface of the discharge tube.

11. The bulk bag unloading station of claim 10 wherein at least a portion of the tube is mounted for movement toward and away from the bag support assembly.

12. The bulk bag unloading station of claim 11 wherein a frame member extends between the moveable portion of the tube and a trolley assembly moveably mounted on the frame structure.

13. The bulk bag unloading station of claim 11 wherein the tube includes a flexible portion extending between the moveable portion and the discharge receptacle.

14. The bulk bag unloading station of claim 12 wherein a fluid actuator is mounted between a mount extending from the frame structure and a mount extending from the trolley assembly whereby movement of the tube corresponds to movement of the fluid actuator.

15. The bulk bag unloading station of claim 14 wherein movement of the fluid actuator is accomplished by gravity and positive actuation of the actuator.

* * * * *

UNITED STATES PATENT AND TRADEMARK OFFICE

CERTIFICATE OF CORRECTION

PATENT NO. : 6,340,100 B1
DATED : January 22, 2002
INVENTOR(S) : Gill et al.

It is certified that error appears in the above-identified patent and that said Letters Patent is hereby corrected as shown below:

Title page,
U.S. PATENT DOCUMENTS, insert --

| | | |
|---|---|---|
| 3,971,493 | 7/1976 | Williams |
| 4,810,156 | 3/1989 | Pendleton et al. |
| 4,942,953 | 7/1990 | Chefson |
| 4,946,071 | 8/1990 | Poulton |
| 5,184,759 | 2/1993 | Gill et al. |
| 5,320,251 | 6/1994 | Ellis |
| 5,322,195 | 6/1994 | Ellis |
| 5,333,757 | 8/1994 | Volk et al. |
| 5,341,959 | 8/1994 | Ellis |
| 5,788,449 | 8/1998 | Riemersma |
| 5,934,517 | 8/1999 | Pieri -- |

FOREIGN PATENT APPLICATION, insert --

| | | |
|---|---|---|
| 1,293,704 | 12/1991 | Canada |
| 1,331,574 | 8/1994 | Canada |
| 2,004,609 | 6/1990 | Canada |
| 2,292,735 | 3/1996 | United Kingdom |
| 2,327,079 | 1/1999 | United Kingdom |
| 2,341,851 | 3/2000 | United Kingdom -- |

UNITED STATES PATENT AND TRADEMARK OFFICE

CERTIFICATE OF CORRECTION

PATENT NO. : 6,340,100 B1
DATED : January 22, 2002
INVENTOR(S) : Gill et al.

It is certified that error appears in the above-identified patent and that said Letters Patent is hereby corrected as shown below:

OTHER DOCUMENTS, insert --
Press Release entitled "New Iso Flo™ High Containment Discharger" dated June 28, 2000
German Literature entitled "System Vertec - die Alternative"; author and date of publication unknown
Page from Control & Metering Web Page entitled "Principles of Discharging" printed on June 1, 2000

Signed and Sealed this

Twenty-sixth Day of March, 2002

*Attest:*

*Attesting Officer*

JAMES E. ROGAN
*Director of the United States Patent and Trademark Office*